US009637341B2

(12) United States Patent
Huang

(10) Patent No.: US 9,637,341 B2
(45) Date of Patent: May 2, 2017

(54) ADHESIVE TAPE DISPENSER

(71) Applicant: Yu-Chun Huang, Taichung (TW)

(72) Inventor: Yu-Chun Huang, Taichung (TW)

( * ) Notice: Subject to any disclaimer, the term of this patent is extended or adjusted under 35 U.S.C. 154(b) by 148 days.

(21) Appl. No.: 14/313,588

(22) Filed: Jun. 24, 2014

(65) Prior Publication Data

US 2015/0368060 A1 Dec. 24, 2015

(51) Int. Cl.
*B65H 35/00* (2006.01)

(52) U.S. Cl.
CPC ..... *B65H 35/008* (2013.01); *B65H 35/00* (2013.01); *B65H 35/0026* (2013.01); *B65H 35/0073* (2013.01); *B65H 2407/10* (2013.01); *Y10T 225/216* (2015.04)

(58) Field of Classification Search
CPC ..... B65H 35/0026; B65H 35/008; B65H 35/0073; B65H 2407/10
USPC ..... 225/19–20; 83/399–400; 192/133–135
See application file for complete search history.

(56) References Cited

U.S. PATENT DOCUMENTS 3,727,868 A * 4/1973 Buchanan ..... B65H 35/0026 242/588.3
4,762,586 A * 8/1988 Wilkie ..... B65H 35/0033 156/527
6,143,391 A * 11/2000 Barnes ..... F16B 47/00 248/205.8
6,662,844 B2 * 12/2003 Huang ..... B65H 35/0033 156/523
9,162,843 B2 * 10/2015 Yu Chen ..... B65H 35/0073
2008/0135181 A1 * 6/2008 Lee ..... B65H 35/0033 156/530
2015/0210501 A1 * 7/2015 Chen ..... B65H 35/008 156/523

FOREIGN PATENT DOCUMENTS

TW 103201573 * 1/2014

* cited by examiner

*Primary Examiner* — Ghassem Alie
*Assistant Examiner* — Nhat Chieu Do
(74) *Attorney, Agent, or Firm* — Muncy, Geissler, Olds & Lowe, P.C.

(57) ABSTRACT

An adhesive tape dispenser includes a tape roll housing holding a cutter blade, a protective member mounted in the tape roll housing and movable relative to the tape roll housing to a first position to expose the cutter blade, a front cover mounted in the tape roll housing in such a manner that the front cover is prohibited from being opened when the protective member is in the first position, or can be opened or received when the protective member is moved to a second position. Further, the cutter blade can be mounted in a cutter holder that is installed in the tape roll housing. With the slidable or biasable design of the protective member and the front cover, the user can selectively expose the cutter blade or enable the cutter blade to be blocked.

1 Claim, 11 Drawing Sheets

ADHESIVE TAPE DISPENSER

BACKGROUND OF THE INVENTION

1. Field of the Invention

The present invention relates to adhesive tape dispensing technology, and more particularly to an adhesive tape dispenser that provides a protective function.

2. Description of the Related Art

An adhesive tape dispenser is a stationery tool commonly used in word processing. Conventional adhesive tape dispensers generally comprise a shaft mounted therein to support an adhesive tape roll. Before application, the lead end of the adhesive tape roll is pulled out of the adhesive tape roll and horizontally adhered to a cutter holder at a front side of the adhesive tape dispenser. In application, pull the lead end of the adhesive tape roll away from the cutter holder to the desired distance and then press a part of the lead end of the adhesive tape roll against the cutter blade at the cutter holder to let the desired length of the lead end of the adhesive tape roll be cut off by the cutter blade for sealing application.

The above-described adhesive tape dispensers have been introduced to the market for years. However, there is a lack of safety considerations in the design of these conventional adhesive tape dispensers. Because the cutter blade in the cutter holder is constantly exposed to the outside, when the user is moving the hand around the cutter holder of the adhesive tape dispenser, the fingers can touch the cutter blade of the cutter holder of the adhesive tape dispenser accidentally, causing finger injury. Further, when the adhesive tape dispenser is placed on a flat bearing surface for enabling the cutter blade of the cutter holder to cut off the lead end of the adhesive tape roll, the user must hold down the tape roll housing of the adhesive tape dispenser with one hand and then pull the lead end of the adhesive tape roll with the other end. This application operation is somewhat inconvenient. Therefore, there is a strong demand for an adhesive tape dispenser that improves the drawbacks of the aforesaid conventional designs.

SUMMARY OF THE INVENTION

The present invention has been accomplished under the circumstances in view. It is the main object of the present invention to provide an adhesive tape dispenser, which allows the user to freely select an operative operation status or a non-operative protective status.

To achieve this and other objects of the present invention, an adhesive tape dispenser of the invention comprises a tape roll housing holding a cutter blade, a protective member mounted in the tape roll housing and movable relative to the tape roll housing between a first position to expose the cutter blade or a second position to block the cutter blade, and a front cover mounted in the tape roll housing and movable relative to the tape roll housing, where the front cover is prohibited from being opened when the protective member is in the first position, where the front cover can be set between an open status and a received status when the protective member is in the second position.

Further, the cutter blade is mounted in a cutter holder that is mounted in the tape roll housing of the adhesive tape dispenser.

The main technical feature of the present invention is that the protective member and front cover of the adhesive tape dispenser are separately biasable or slidable between an operative operation status to expose the cutter blade of the cutter holder and a non-operative protective operation status to block and protect the cutter blade of the cutter holder, thereby achieving the effects and purposes of the present invention.

Preferably, the adhesive tape dispenser further comprises a locking mechanism. Biasing an operating member of the locking mechanism can move a locating member of the locking mechanism to a locked position, enhancing the positioning stability of the tape roll housing of the adhesive tape dispenser, and thus, the user can directly pull the lead end of the adhesive tape roll for application without needing to hold down the tape roll housing of the adhesive tape dispenser with one hand.

Other advantages and features of the present invention will be fully understood by reference to the following specification in conjunction with the accompanying drawings, in which like reference signs denote like components of structure.

DETAILED DESCRIPTION OF THE INVENTION

Figure 1:
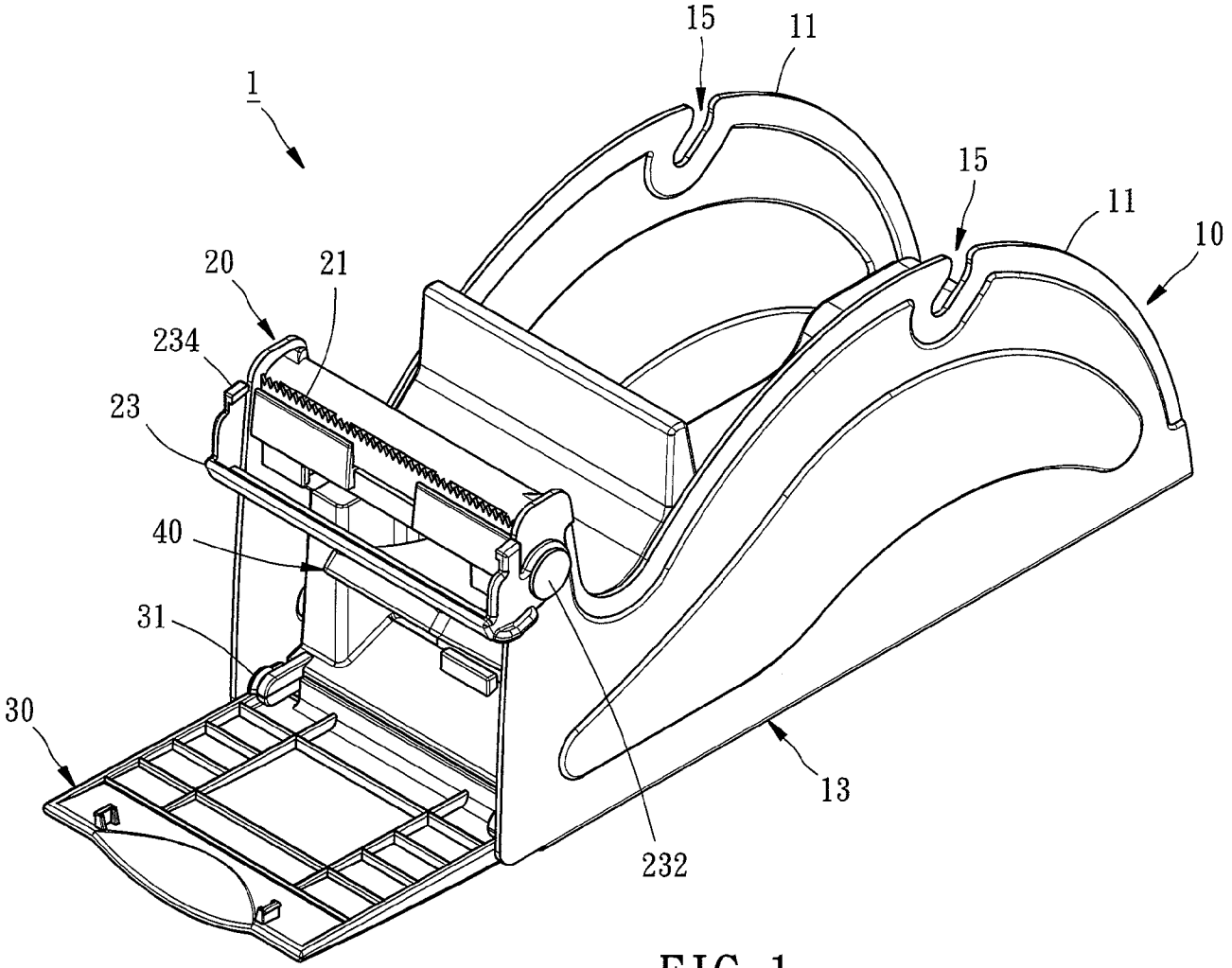
FIG. 1 is an oblique top elevational view of an adhesive tape dispenser in a first operation status in accordance with the present invention.
Figure 2:
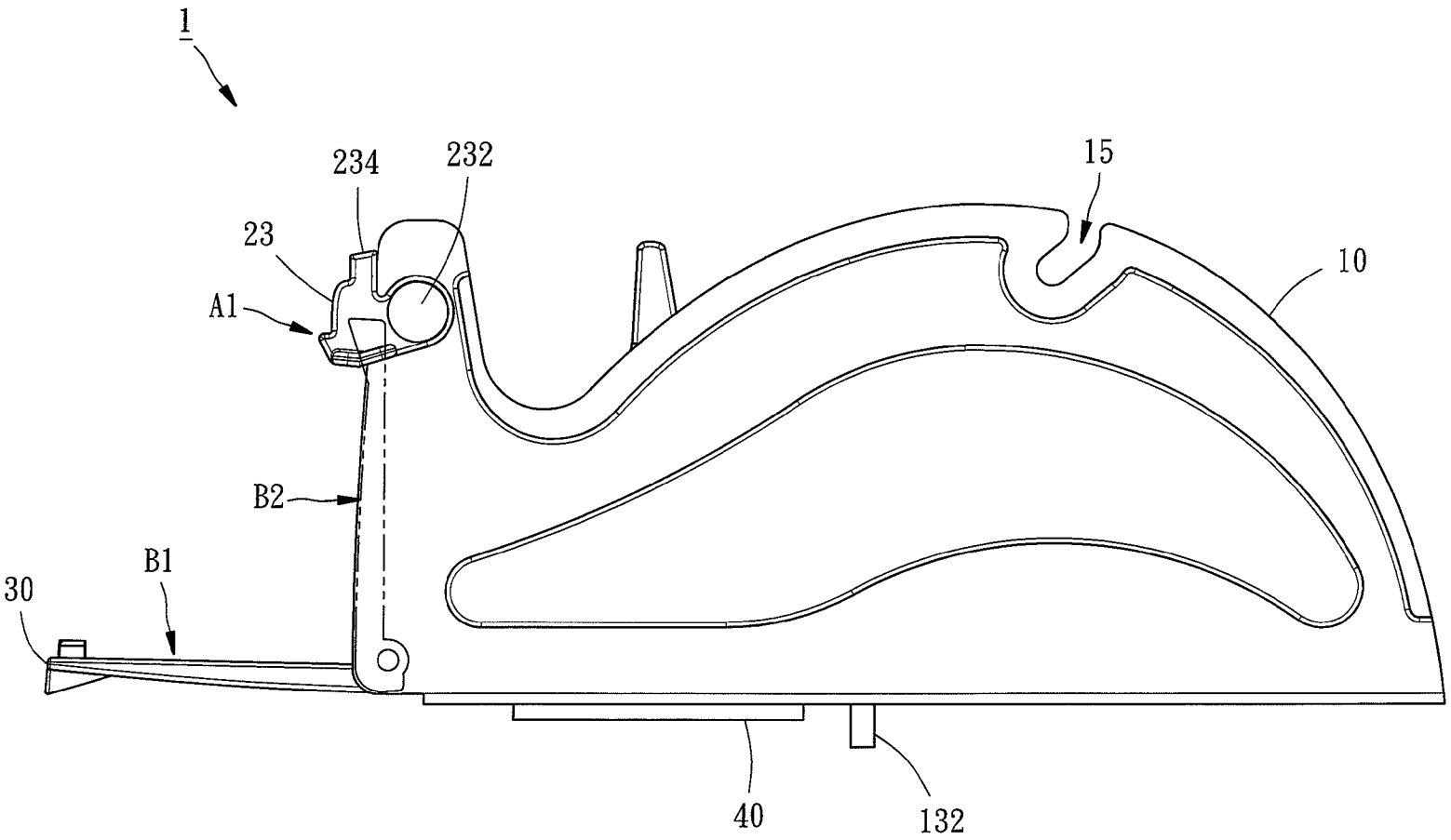
FIG. 2 is a schematic side view of the adhesive tape dispenser in the first operation status in accordance with the present invention.

Referring to FIGS. 1 and 2, an adhesive tape dispenser in a first operation status in accordance with the present invention is shown. The adhesive tape dispenser 1 comprises a tape roll housing 10, a cutter holder 20, a front cover 30, and a locking mechanism 40.

The tape roll housing 10 comprises a bottom panel 13, two arched side panels 11 symmetrically located at two opposite lateral sides of the bottom panel 13, a bearing portion 15 located in each arched side panel 11 and inwardly curved from the topmost peripheral edge of the respective arched side panel 11 for supporting an axle member (not shown) to hold an adhesive tape roll (not shown), and two engagement portions 17 transversely located in a front side thereof.

Figure 7:
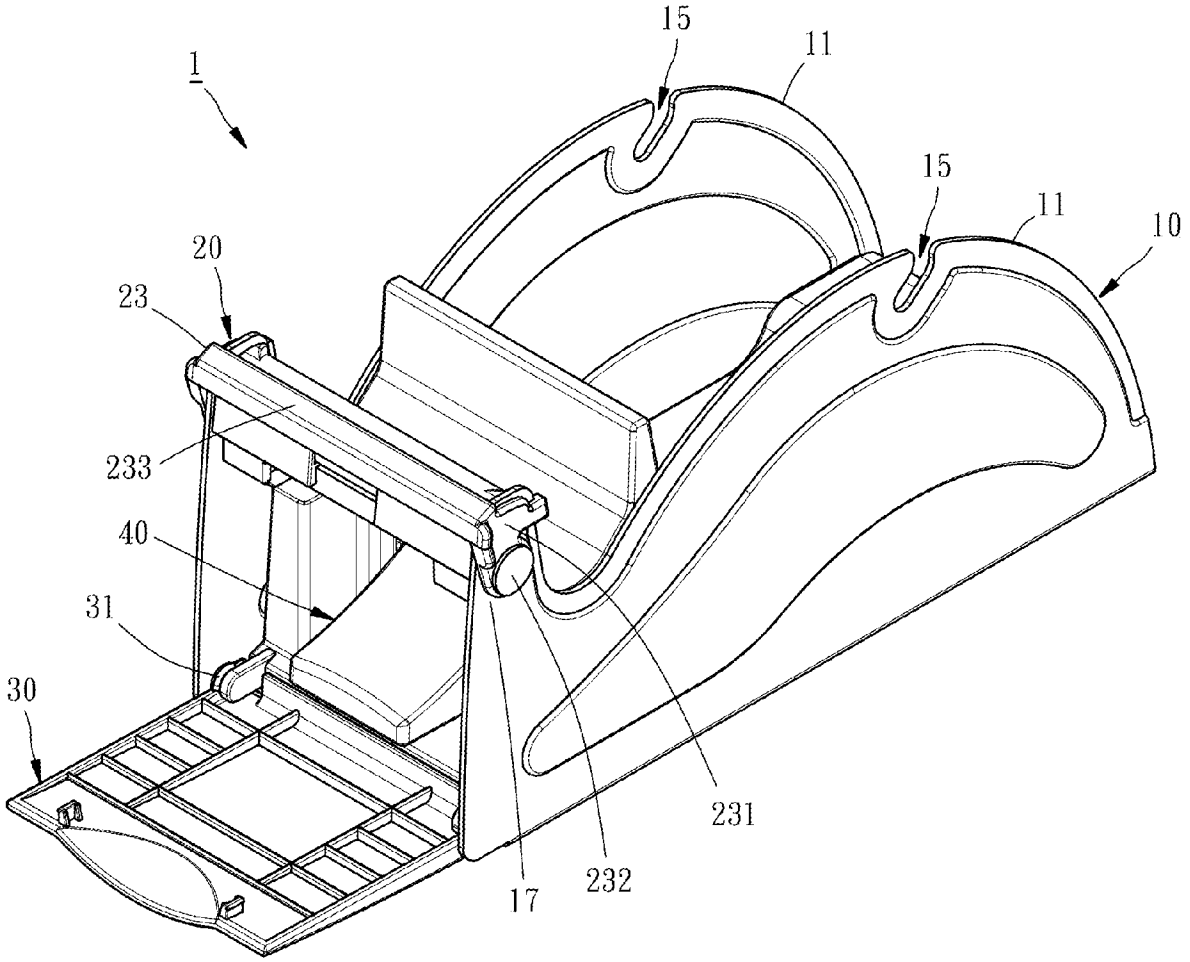
FIG. 7 is a schematic oblique top elevational view of the adhesive tape dispenser in a fifth operation status in accordance with the present invention.

The cutter holder 20 is mounted in one end of the tape roll housing 10 remote from the bearing portions 15, comprising a serrated cutter blade 21 for cutting off a certain length of an extended lead end of the adhesive tape roll (not shown) that is rotatably supported between the bearing portions 15 of the housing 10, and a protective member 23 pivotally coupled to the arched side panels 11 of the tape roll housing 10 and the cutter holder 20 by two pivot shafts 232 and adapted for covering the cutter blade 21. As shown in FIG. 7, the protective member 23 comprises two pivot ears 231 pivotally connected with the engagement portions 17 by the two pivot shaft 232, respectively. A protective portion 233 is connected with the two pivot ears (231) and moveable along with the two ears 231 to cover the cutter blade 21 and the two engagement portions 17 of the tape roll housing 10. The protective member 23 further comprises two retaining lugs 234. Rotating the protective member 23 relative to the tape roll housing 10 through a predetermined angle causes the retaining lugs 234 to be forced into engagement with the engagement portions 17 of the tape roll housing 10.

The front cover 30 has one end thereof pivotally connected to the bottom panel 13 of the tape roll housing 10 by a pivot shaft 31, and can be biased relative to the tape roll housing 10 and forced into engagement between the arched side panels 11 of the tape roll housing 10.

The locking mechanism 40 is mounted in the bottom panel 13 of the tape roll housing 10 adjacent to the front cover 30, comprising an operating member 41, a guide block 43, a stop member 45, a locating member 47 and a spring member 49. The operating member 41 has one end thereof pivotally connected to the guide block 43. The guide block 43 has an arched segment 432 located at a top side thereof. Further, the guide block 43 has one end thereof connected to the stop member 45. The stop member 45 is movable along the arched segment 432 of the guide block 43, having one end thereof connected to the locating member 47. The spring member 49 is mounted around the stop member 45 and stopped against the locating member 47 for storing an elastic potential energy. Further, the locating member 47 in this embodiment is a vacuum mount.

After understanding the composition of the component parts of the adhesive tape dispenser, the operation of the adhesive tape dispenser is outlined hereinafter.

As stated above, the protective member 23 and front cover 30 of the adhesive tape dispenser 1 are pivotable relative to the tape roll housing 10. When the adhesive tape dispenser 1 is in the first operation status, the protective member 23 is biased in direction away from the cutter holder 20 to a first position A1 (the open position). At this time, the front cover 30 of the adhesive tape dispenser 1 is moved to a first position B1 (the open position) to match with the first position A1 (the open position) of the cutter holder 20. Thus, the cutter blade 21 of the cutter holder 20 is exposed to the outside for cutting operation, achieving the expected effects and purposes of the present invention.

Figure 3:
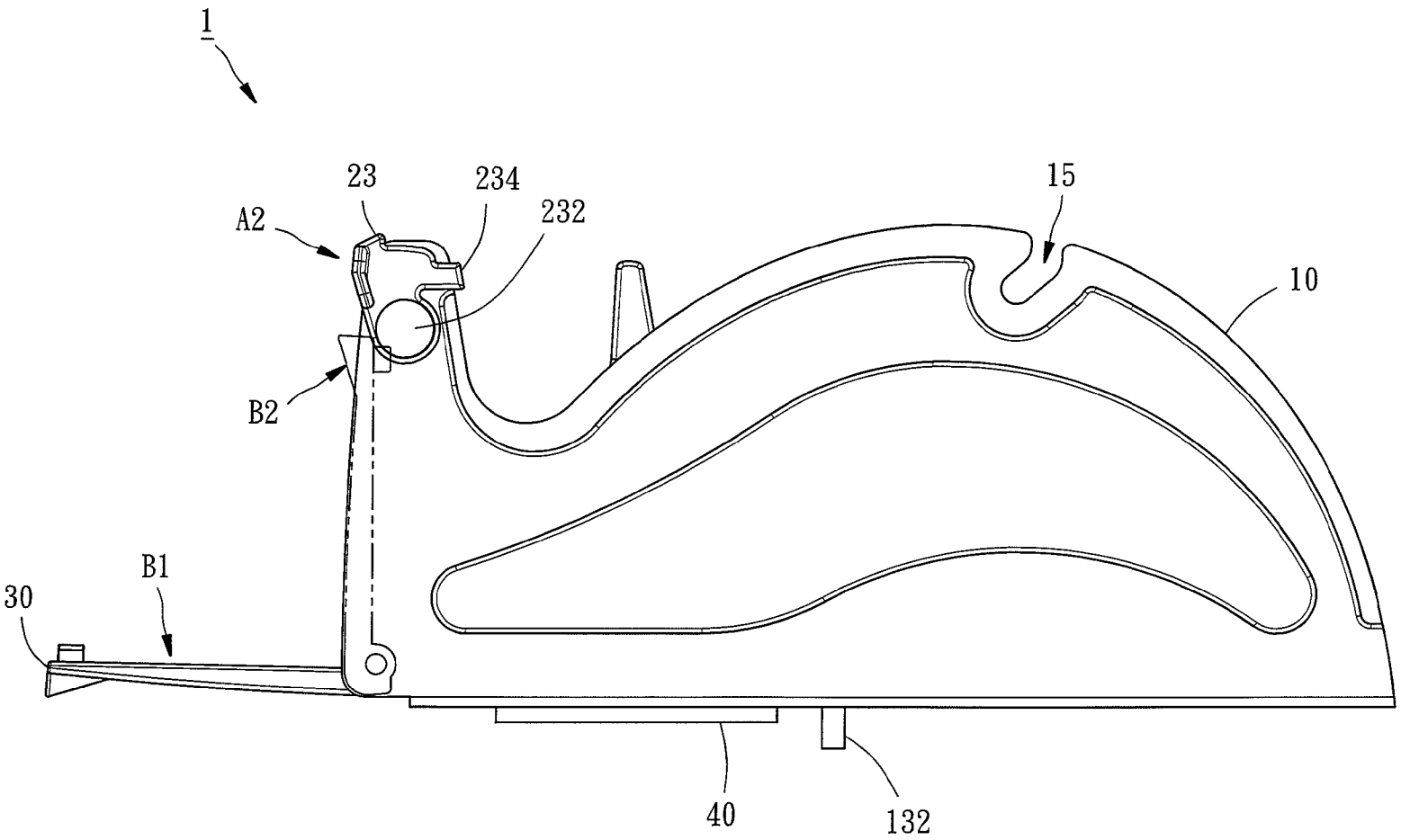
FIG. 3 is a schematic side view of the adhesive tape dispenser in a second operation status in accordance with the present invention.
Figure 4:
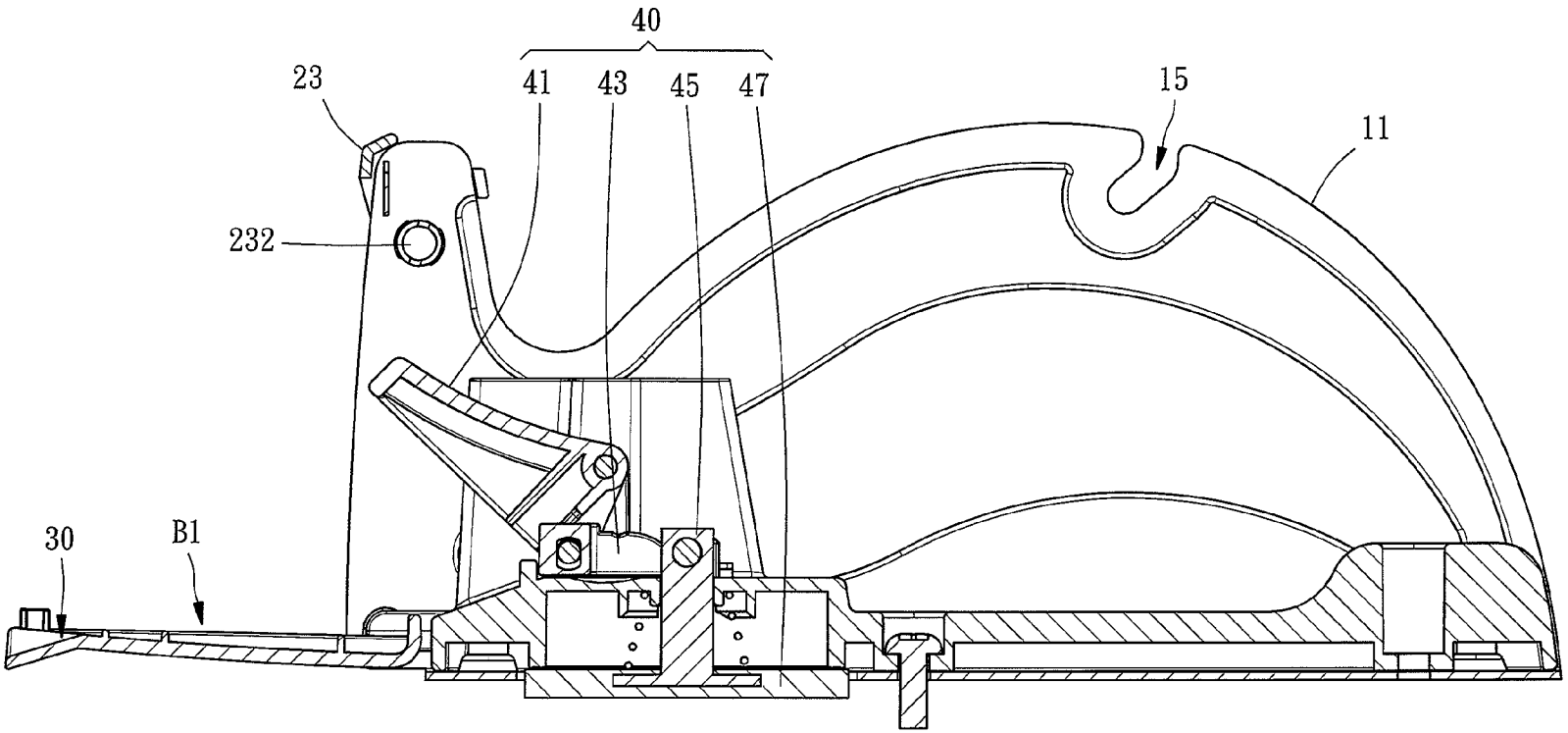
FIG. 4 is a schematic sectional view of the adhesive tape dispenser in the second operation status in accordance with the present invention.
Figure 5:
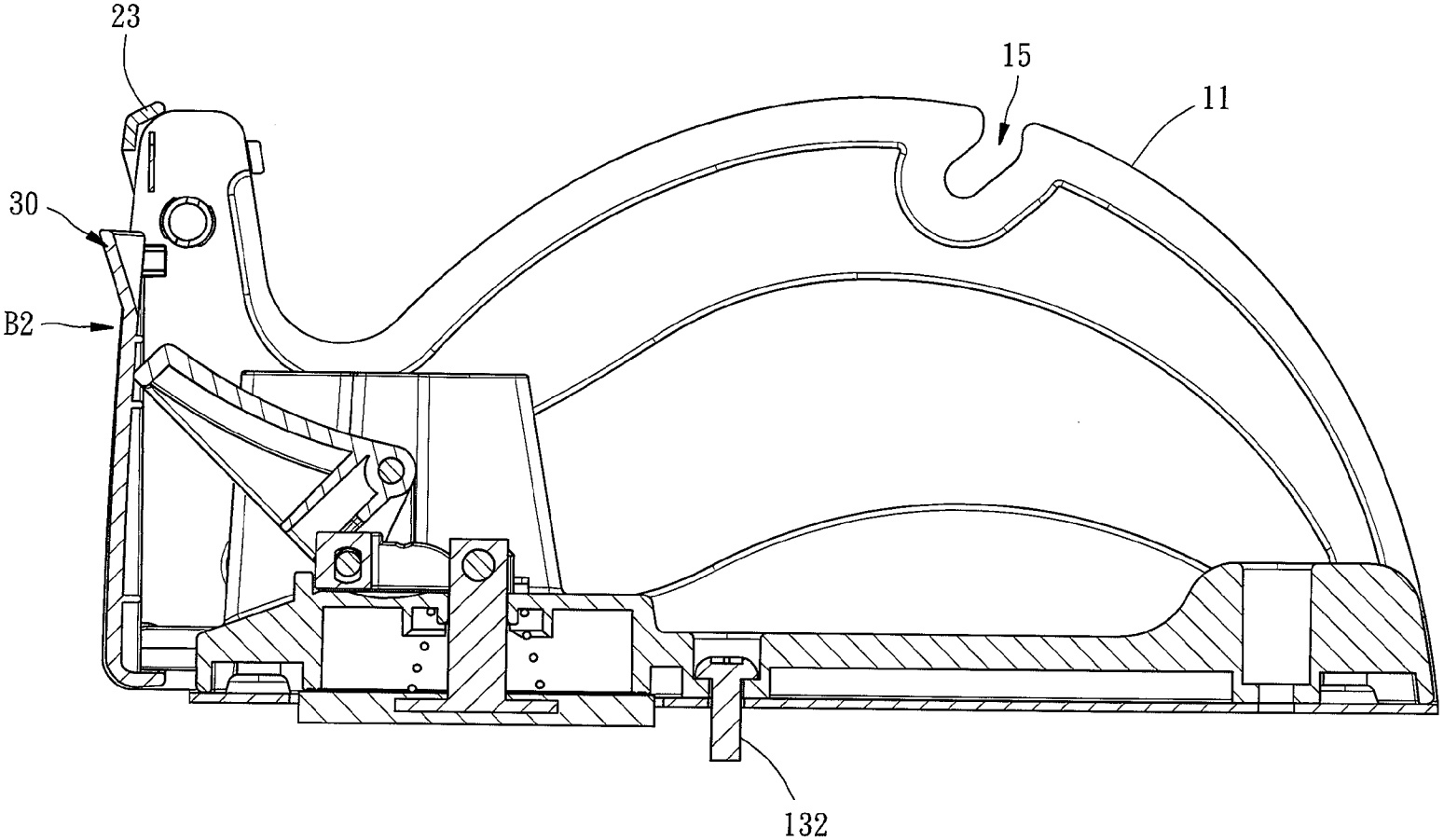
FIG. 5 is a schematic sectional view of the adhesive tape dispenser in a third operation status in accordance with the present invention.

Referring also to FIGS. 3 and 4, the adhesive tape dispenser 1 is shown in a protective operation status. In this status, the protective member 23 of the adhesive tape dispenser 1 is biased in direction toward the arched side panels 11 to a second position A2 (the close position) to force the retaining lugs 234 thereof into engagement with the engagement portions 17 of the tape roll housing 10. At this time, the cutter blade 21 of the cutter holder 20 is blocked by the protective member 23. Thus, the cutter blade 21 of the cutter holder 20 is kept from sight. Further, as shown in FIG. 5, the front cover 30 is not constrained by the protective member 23 of the cutter holder 20 under this operation status, and can be freely biased between an opened status and a received status. Thus, the front cover 30 of the adhesive tape dispenser 1 can be biased to the second position B2 and engaged between the two arched side panels 11 of the tape roll housing 10 to match with the second position A2 of the protective member 23 of the cutter holder 20. Thus, the adhesive tape dispenser 1 provides a protective function and facilitates storage when not used, achieving the expected effects and purposes of the present invention.

Figure 6:
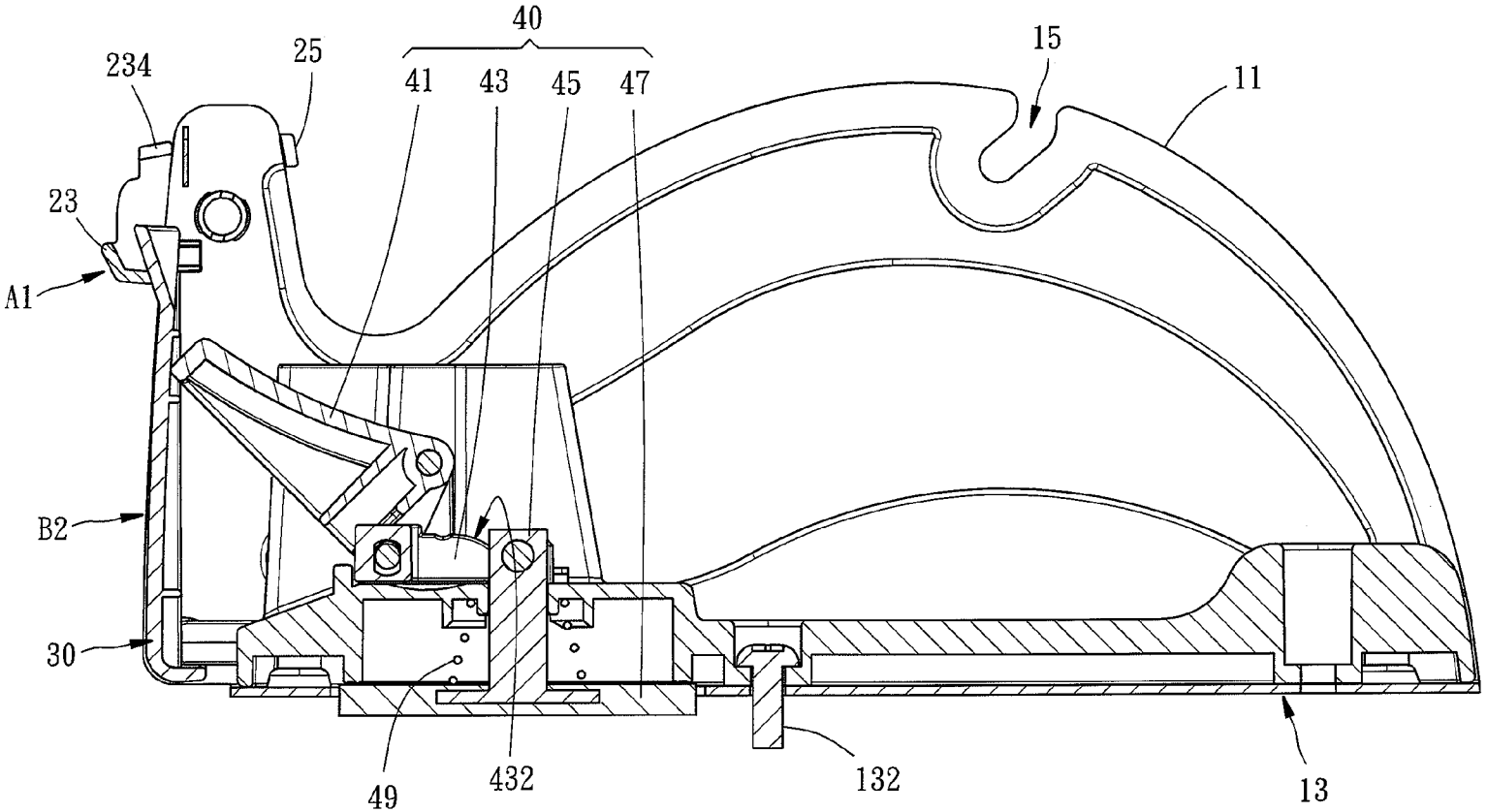
FIG. 6 is a schematic sectional view of the adhesive tape dispenser in a fourth operation status in accordance with the present invention.

Referring also to FIG. 6, the adhesive tape dispenser 1 is shown in another operation status. In this operation status, bias the protective member 23 of the adhesive tape dispenser 1 toward the arched side panels 11 of the tape roll housing 10 to the second position A2, and then bias the front cover 30 to the second position B2 to match with the second position A2 of the protective member 23 of the cutter holder 20, and then bias the protective member 23 toward the body of the cutter holder 20 to the first position A1 (the open status) to expose the cutter blade 21 of the cutter holder 20. At this time, the front cover 30 is prohibited by the protective member 23 of the cutter holder 20 from being opened, achieving the desired operation status. Under this operation status, the adhesive tape dispenser 1 is workable in a limited space to achieve the expected effects and purposes of the present invention.

Figure 8:
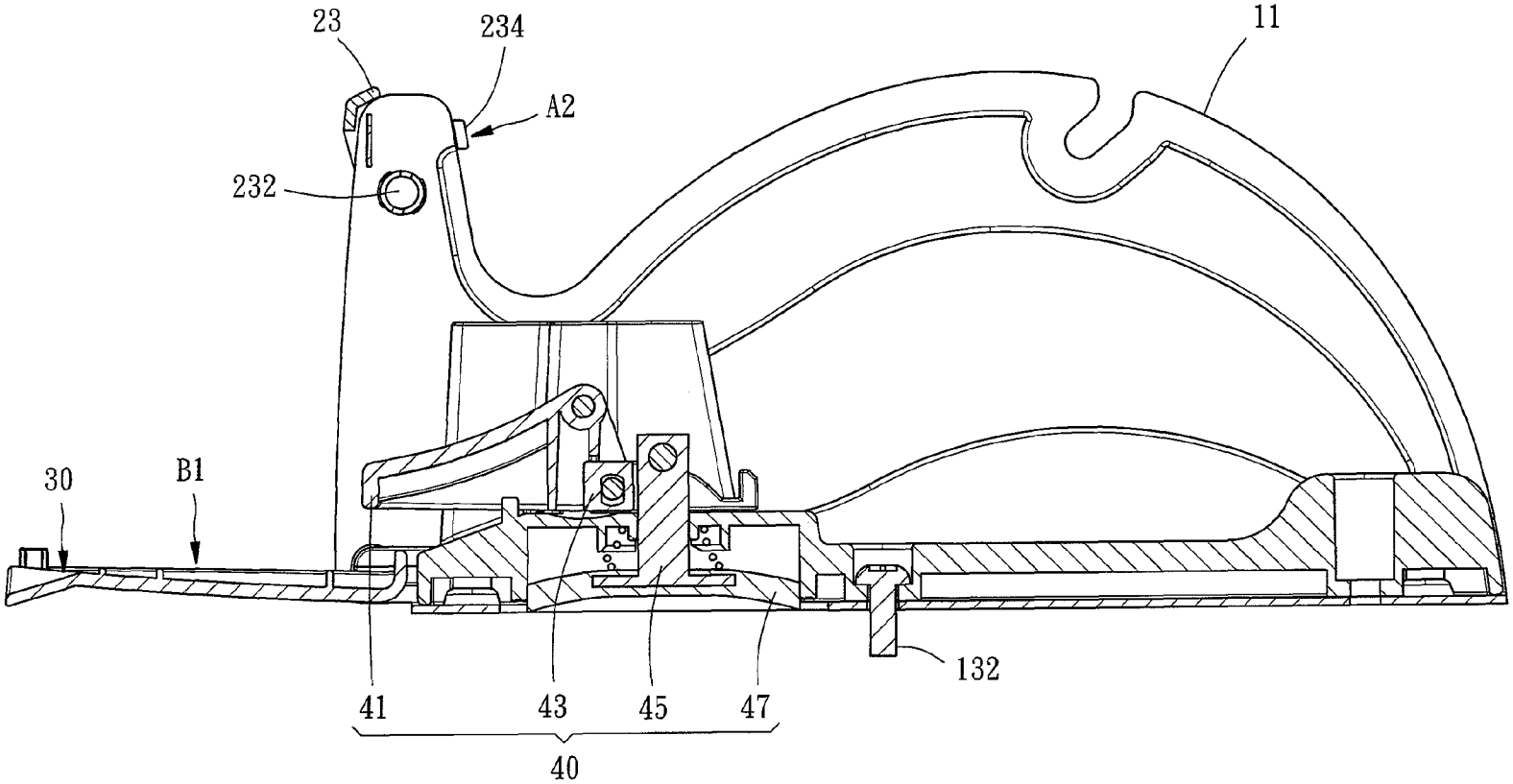
FIG. 8 is a schematic sectional view of the adhesive tape dispenser in the fifth operation status in accordance with the present invention.

Referring also to FIGS. 7 and 8, the adhesive tape dispenser 1 is shown locked in a protective operation status. In this operation status, bias protective member 23 of the adhesive tape dispenser 1 toward the arched side panels 11 of the tape roll housing 10 to the second position A2. At this time, the front cover 30 is maintained in the first position B1 to match with the protective member 23 of the cutter holder 20. Thereafter, bias the operating member 41 of the locking mechanism 40 of the adhesive tape dispenser 1 from the original first angle position to a second angle position. At this time, the guide block 43 that is pivotally connected to the operating member 41 of the locking mechanism 40 is shifted from an operative first position to a locked second position. At the same time, the stop member 45 of the locking mechanism 40 is moved in a mirror direction relative to the moving direction of the guide block 43 of the locking mechanism 40 till it is stopped against the guide block 43. The stop member 45 of the locking mechanism 40 is also moved along the arched segment 432 of the guide block 43 from the original first curved-surface position to a second curved-surface position and stopped at one side of the operating member 41. At this time, because the locating member 47 of the locking mechanism 40 is connected to the stop member 45, it is changed from an unlocked status to a locked status. Preferably, the elastic potential energy of the spring member 49 of the locking mechanism 40 enhances the position of the locating member 47 in the locked status. Most preferably, the bottom panel 13 of the tape roll housing 10 provides a locking member 132 for locking to a carrier (not shown) or bearing surface (not shown), achieving the expected effects and purposes of the present invention.

Figure 9:
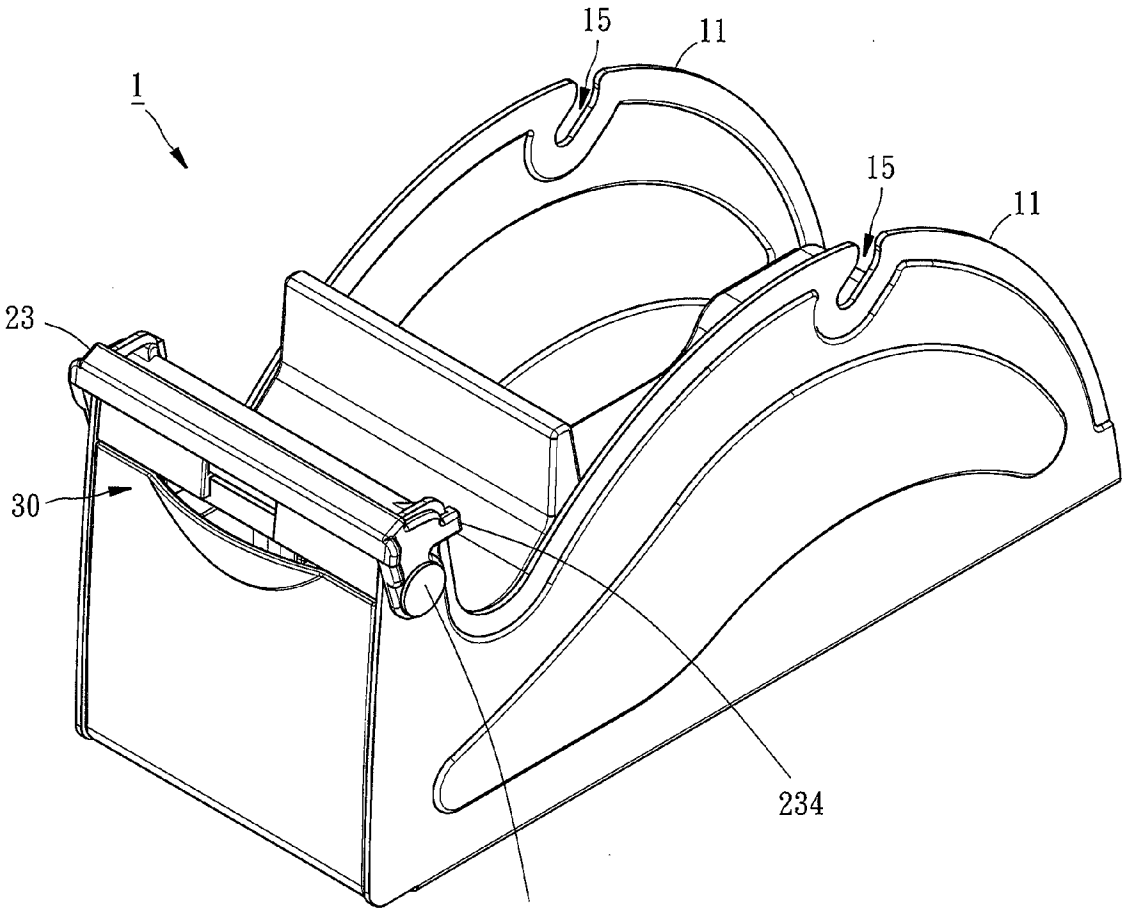
FIG. 9 is a schematic oblique top elevational view of the adhesive tape dispenser in a sixth operation status in accordance with the present invention.
Figure 10:
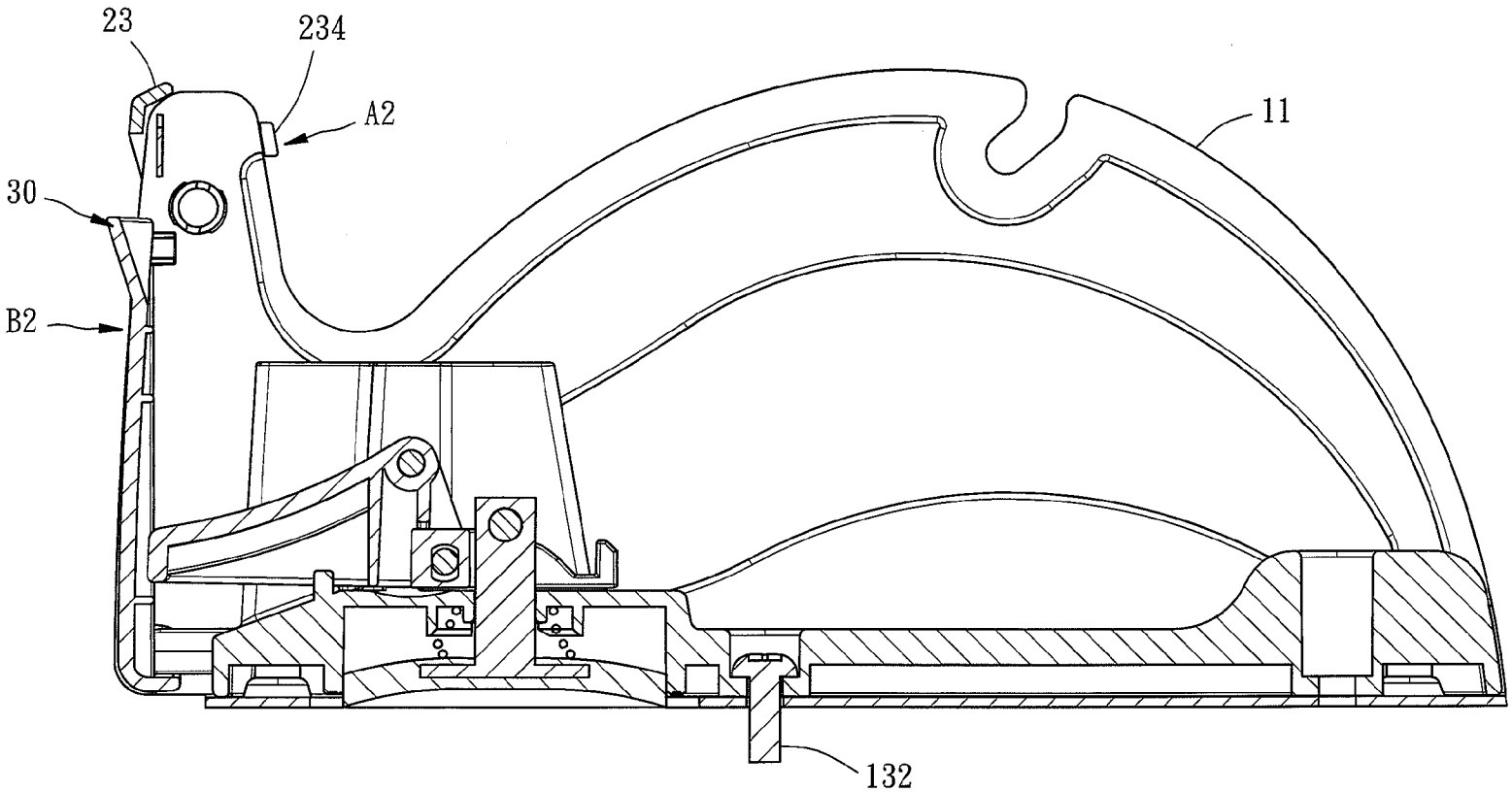
FIG. 10 is a schematic sectional view of the adhesive tape dispenser in the sixth operation status in accordance with the present invention.

Referring also to FIGS. 9 and 10, the adhesive tape dispenser 1 is shown locked in another protective operation status, i.e., the received operation status. The operation is to follow up the aforesaid locked operation status, and then to move the front cover 30 of the adhesive tape dispenser 1 to the second position B2 in match with the protective member 23 of the cutter holder 20. At this time, the positioning stability of the adhesive tape dispenser 1 is enhanced, facilitating storage and achieving the expected effects and purposes of the present invention.

Figure 11:
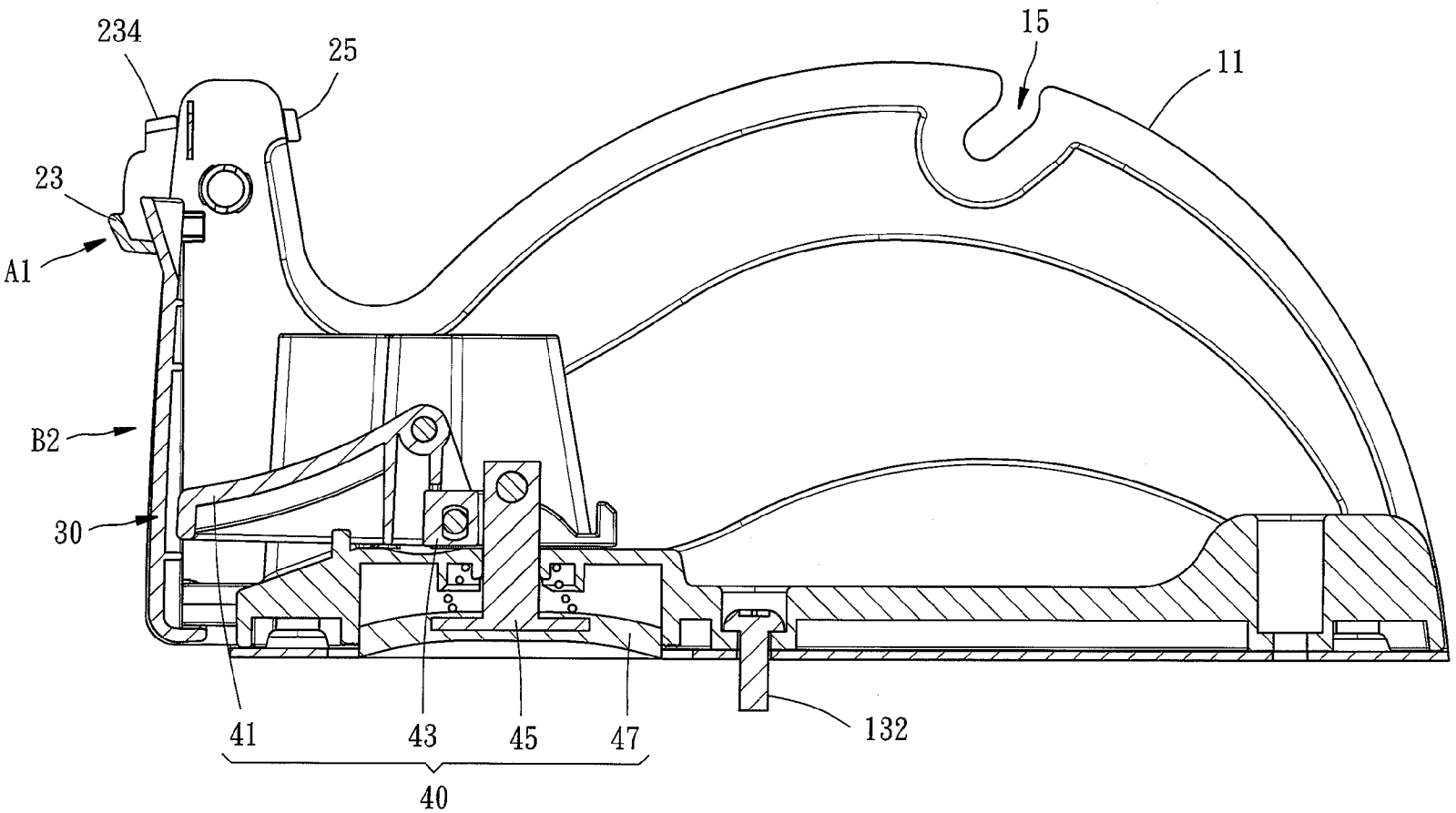
FIG. 11 is a schematic sectional view of the adhesive tape dispenser in a seventh operation status in accordance with the present invention.

Referring also to FIG. 11, the adhesive tape dispenser 1 is shown in an operation status after locking of the locking mechanism. After entered the aforesaid locked status, the tape roll housing 10 of the adhesive tape dispenser 1 is locked by the locking mechanism 40, the front cover 30 of the adhesive tape dispenser 1 is in the second position B2 to match with the protective member 23 of the cutter holder 20. At this time, bias the protective member 23 of the cutter holder 20 away from the second position A2 to block the cutter blade 21 to the first position A1 to expose the cutter blade 21 of the cutter holder 20, finishing the operation, and thus, the user can directly and conveniently apply the adhesive tape roll without needing to hold down the tape roll housing 10 of the adhesive tape dispenser 1 with one hand.

In conclusion, the adhesive tape dispenser of the present invention has the technical features: the protective member 23 and front cover 30 of the adhesive tape dispenser 1 are separately biasable between an operative status to expose the cutter blade 21 of the cutter holder 20 and a protective status to block and protect the cutter blade 21 of the cutter holder 20. Further, the user can bias the operating member 41 of the locking mechanism 40 of the adhesive tape dispenser 1 to a locked operation status, enhancing the positioning stability of the tape roll housing 10 of the adhesive tape dispenser 1 so that the user can directly dispense the adhesive tape roll without needing to hold down the tape roll housing 10 with the hand during application, achieving the expected effects and purposes of the present invention.

Except the aforesaid preferred embodiment, the invention can also be variously embodied as follows:

For example, in the aforesaid preferred embodiment, the protective member 23 of the adhesive tape dispenser 1 is biasable between the first position A1 and the second position A2. Alternatively, the protective member 23 can be slidably mounted in the tape roll housing 10 of the adhesive tape dispenser 1 and moved linearly between the first position A1 and the second position A2.

Further, in the aforesaid preferred embodiment, the front cover 30 is pivotally connected to the tape roll housing 10 of the adhesive tape dispenser 1 and biasable between the first position B1 and the second position B2 to match with the position of the protective member 23. Alternatively, the protective member 23 can be slidably mounted in the tape roll housing 10 of the adhesive tape dispenser 1 and moved linearly between the first position B1 and the second position B2.

Further, in the aforesaid preferred embodiment of the present invention, the serrated cutter blade 21 is mounted in the cutter holder 20 of the adhesive tape dispenser 1. Alternatively, the cutter blade 21 can be directly mounted in the tape roll housing 10 of the adhesive tape dispenser 1 without the cutter holder 20.

Further, the adhesive tape dispenser 1 can be configured without the aforesaid locking mechanism 40, achieving the same effects and purposes of the present invention.

What is claimed is:

1. An adhesive tape dispenser, comprising:

a tape roll housing comprising a cutter blade;

a protective member mounted in said tape roll housing and movable relative to said tape roll housing between a first position to expose said cutter blade and a second position to block said cutter blade; and a front cover mounted in said tape roll housing, where said front cover is prohibited from being opened from said tape roll housing when said protective member is in the first position, where said front cover is movable relative to said tape roll housing between an open status and a received status when said protective member is in the second position;

wherein said protective member is movable between said first position and second position by a pivoting motion;

wherein said tape roll housing comprises two engagement portions connected with two lateral ends of said cutter blade, respectively;

wherein said protective member comprises two pivot ears pivotally connected with the engagement portions by two pivot shaft respectively, a protective portion connected with said two pivot ears and moveable along with said two ears to cover said cutter blade and said two engagement portions of said tape roll housing, and two retaining lugs engaged with said engagement portions of said tape roll housing when said protective member is moved to the second position;

wherein the adhesive tape dispenser further comprises a locking mechanism mounted in a bottom panel of said tape roll housing adjacent to said front cover, said locking mechanism comprising an operating member, and a locating member connected to said operating member and movable by said operating member; wherein the locating member is a vacuum mount;

wherein the front cover is pivotally connected with the tape roll housing and located below the cutter blade; and wherein when the front cover is pivotally moved toward the cutter blade, the front cover covers the tape roll housing.

* * * * *